US007448509B2

(12) United States Patent
Yang

(10) Patent No.: US 7,448,509 B2
(45) Date of Patent: Nov. 11, 2008

(54) COMBINATION OF LARGE AND SMALL COVERS FOR WATER BAG

(76) Inventor: Shih-Sheng Yang, Wu Kung Er Rd., Wu Ku Hsiang, Taipei Hsien (TW)

( * ) Notice: Subject to any disclaimer, the term of this patent is extended or adjusted under 35 U.S.C. 154(b) by 726 days.

(21) Appl. No.: 10/943,899

(22) Filed: Sep. 20, 2004

(65) Prior Publication Data

US 2006/0070998 A1 Apr. 6, 2006

(51) Int. Cl.

| | |
|---|---|
| ***B65D 41/04*** | (2006.01) |
| ***B65D 51/18*** | (2006.01) |
| ***B65D 55/16*** | (2006.01) |
| *B65D 53/02* | (2006.01) |

(52) U.S. Cl. ..... 220/254.8; 220/259.4; 220/304; 220/288; 220/375

(58) Field of Classification Search ..... 220/375, 220/254.8, 254.1, 255, 254.2, 304, 256.1, 220/259.3, 259.4, 529.3, 288; 383/80, 66
See application file for complete search history.

(56) References Cited

U.S. PATENT DOCUMENTS

| | | | | |
|---|---|---|---|---|
| 4,470,164 | A * | 9/1984 | Soderstrom et al. | 5/671 |
| 4,813,569 | A * | 3/1989 | Ruiz | 220/254.8 |
| 5,279,025 | A * | 1/1994 | Kinast | 29/436 |
| 5,353,944 | A * | 10/1994 | Davis et al. | 220/303 |
| 5,881,783 | A * | 3/1999 | Chou | 141/351 |
| 6,571,972 | B1 * | 6/2003 | Bouc et al. | 220/254.2 |
| 6,675,998 | B2 * | 1/2004 | Forsman et al. | 224/148.2 |
| 6,820,780 | B2 * | 11/2004 | Forsman et al. | 224/148.2 |
| 7,066,337 | B2 * | 6/2006 | Hsu | 210/452 |
| 2004/0211778 | A1 * | 10/2004 | Lien | 220/212.5 |
| 2004/0217117 | A1 * | 11/2004 | Lien | 220/375 |
| 2005/0254734 | A1 * | 11/2005 | Yang | 383/80 |

* cited by examiner

*Primary Examiner*—Anthony D Stashick
*Assistant Examiner*—Niki M Eloshway
(74) *Attorney, Agent, or Firm*—Leong C. Lei

(57) ABSTRACT

A combination of large and small covers for a water bag is provided on a water bag, composing a base, a cover of large diameter coupled to the base, and a cover of small diameter mounted onto the cover of large diameter. The base has a vertical wall, which is vertically provided with an extension rim around the periphery of the bottom, the vertical wall of the base is provided with exterior threads. In the center of the cover of large diameter is provided with a hole with interior threads for coupling with the exterior threads of the base, whereas the cover of small diameter is provided with exterior threads at its periphery and a switch piece on the top. Thereby both of the covers of small diameter and large diameter can be easily rotated to open and close for various utilities.

1 Claim, 6 Drawing Sheets

COMBINATION OF LARGE AND SMALL COVERS FOR WATER BAG

BACKGROUND OF THE INVENTION (a) Technical Field of the Invention

The present invention relates to a combination of large and small covers for a water bag, and particularly to a water bag cover having two covers of different diameters such that said two covers of different sizes can be switched for the purposes of refilling drinks and cleaning the interior of the water bag.

(b) Description of the Prior Art

Cycling has become a popular outdoor activity in terms of leisure, sports or traffic transportation. To solve the drinking issue during cycling, a water bag for carrying drinks has been designed, such that the cyclist can carry the water bag on his/her back and drink the water contained inside by way of a conduit extended from the water bag and a mouthpiece connected with the conduit. When the cyclist holds the mouthpiece in his/her mouth, and drink the water from the water bag by way of the opening and closing of the central crevice of the mouthpiece due to the user's biting force. Besides, given the provision of the large outlet, the user can clean the water bag easily.

The design of water bag provided with a large outlet for cleaning purpose as disclosed in U.S. patent application Ser. No. 09/902,935 entitled "Hydration System with Improved Fluid Reservoir" is composed of a reservoir which has a main portion including a interior partition for containing drink. The interior partition includes a refilling conduit composing an opening neck for adding in or pouring out drink, and a cover which is a removable cover being able to be alternatively closed. Besides, the cover further includes a plug which extends into the opening neck for firmly shut the fluid.

Wherein the cover is in form of a large switch cover for fastening and loosening purposes. As plastic is resilient, plastic articles of large size would have more chances of transformation, such that when the cover is fastened to the opening of the reservoir, crevice would easily generate and occur water leak. To prevent this, the combination tolerance in size must be provided extremely tight. However, it is hard for children and women to open the cover due to over tightness and affects the convenience in use.

Although the water bag can solve the drinking issue during sports, if the user needs to take a longer trip, he/she needs to constantly open the cover for supplementing water. However, the chances of cleaning the water bag are comparatively rare. In view of apparent proportion of drinking water and cleaning the water bag, the inventor has disclosed improvements on the disadvantages existing in the prior art and provided a cover structure to ease the user to refill water and clean the water bag.

SUMMARY OF THE INVENTION

The primary object of the invention is to provide a combination of large and small covers for a water bag, which is composed of a base, a cover of large diameter coupled to the base, and a cover of small diameter mounted onto the cover of large diameter. Accordingly, the covers of large diameter and small diameter can be respectively rotated to open for various purposes. Another object of the invention is to provide a combination of large and small covers for a water bag. In view of the provision of an open on the cover of large diameter for coupling the cover of small diameter, the rigidity of the structure of the cover of large diameter becomes perfect, such that when the cover of large diameter is coupled with the water bag, the crevice is not overly tight, the water would not leak out, and the cover can be easily rotated to loosen.

To obtain the above objects, the invention relates to a combination of large and small covers for a water bag is provided on a water bag, composing a base, a cover of large diameter coupled to the base, and a cover of small diameter mounted onto the cover of large diameter. The base has a vertical wall, which is vertically provided with an extension rim around the periphery of the bottom, the vertical wall of the base is provided with exterior threads. The cover of large diameter is provided with interior threads at the interior gap. In the center of the cover of large diameter is provided with a hole with interior threads on the inner wall, whereas the cover of small diameter is provided with exterior threads at its periphery and a switch piece on the top. Thereby the cover of large diameter can be easily coupled to the base, and both of the covers of large diameter and small diameter can be respectively rotated to open for various purposes. For example, if the user wishes to refill drinking water, he/she needs only open the cover of small diameter, and if the user wishes to clean the inside of the water bag after use, he/she can open the cover of large diameter.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
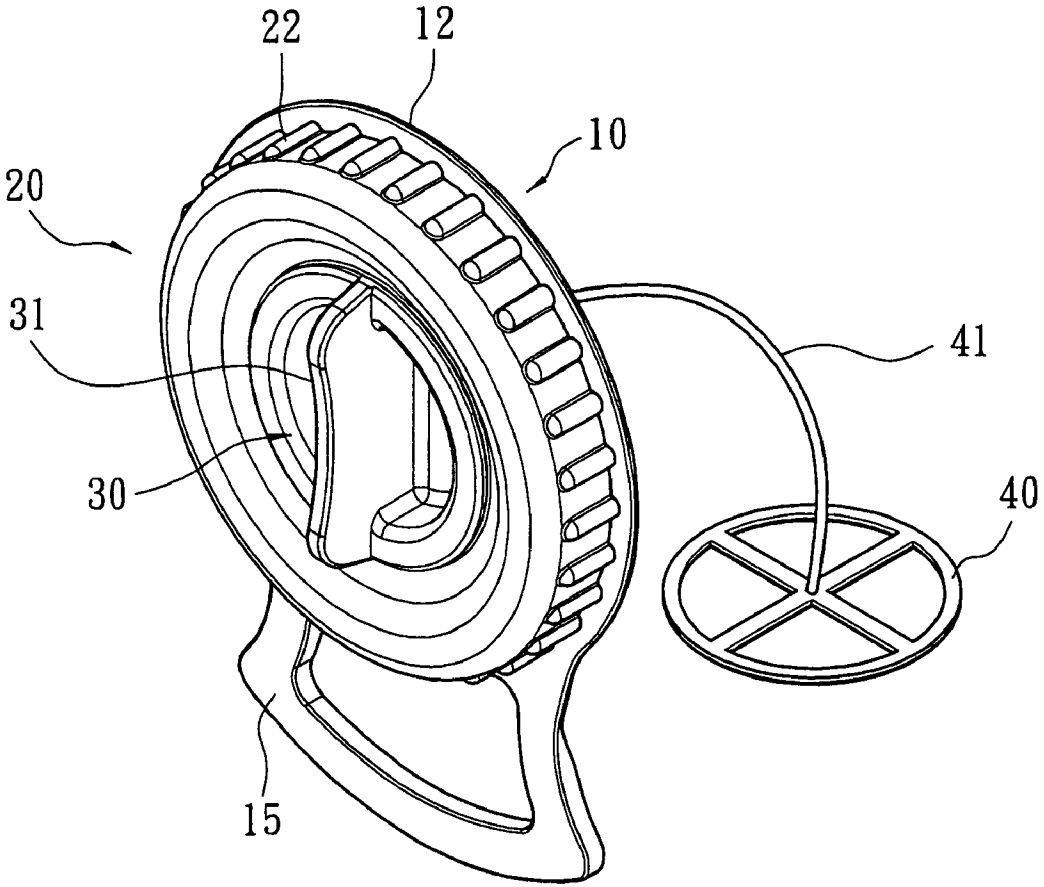
FIG. 1 is a perspective view of the present invention.
Figure 2:
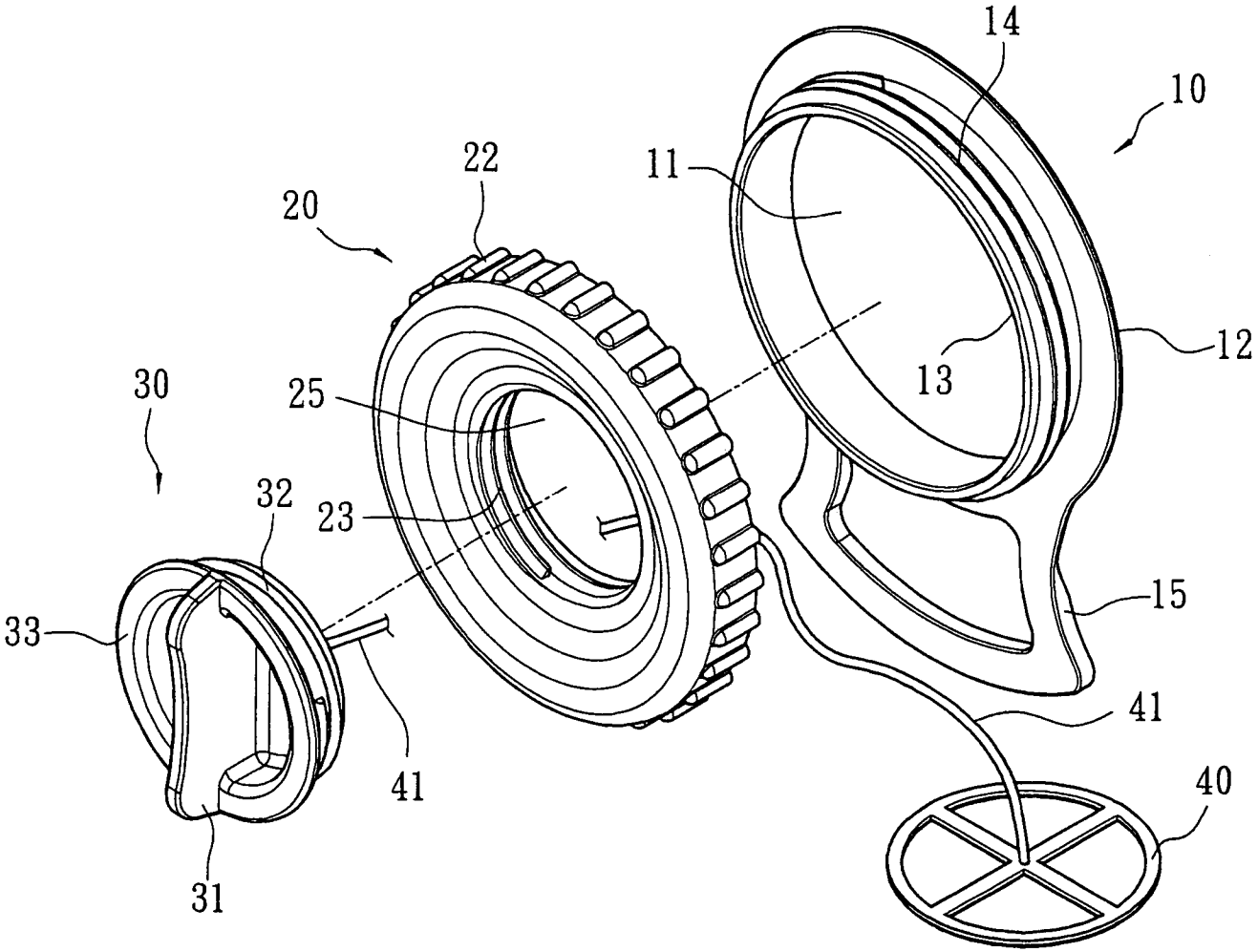
FIG. 2 is an exploded view of the present invention.
Figure 3:
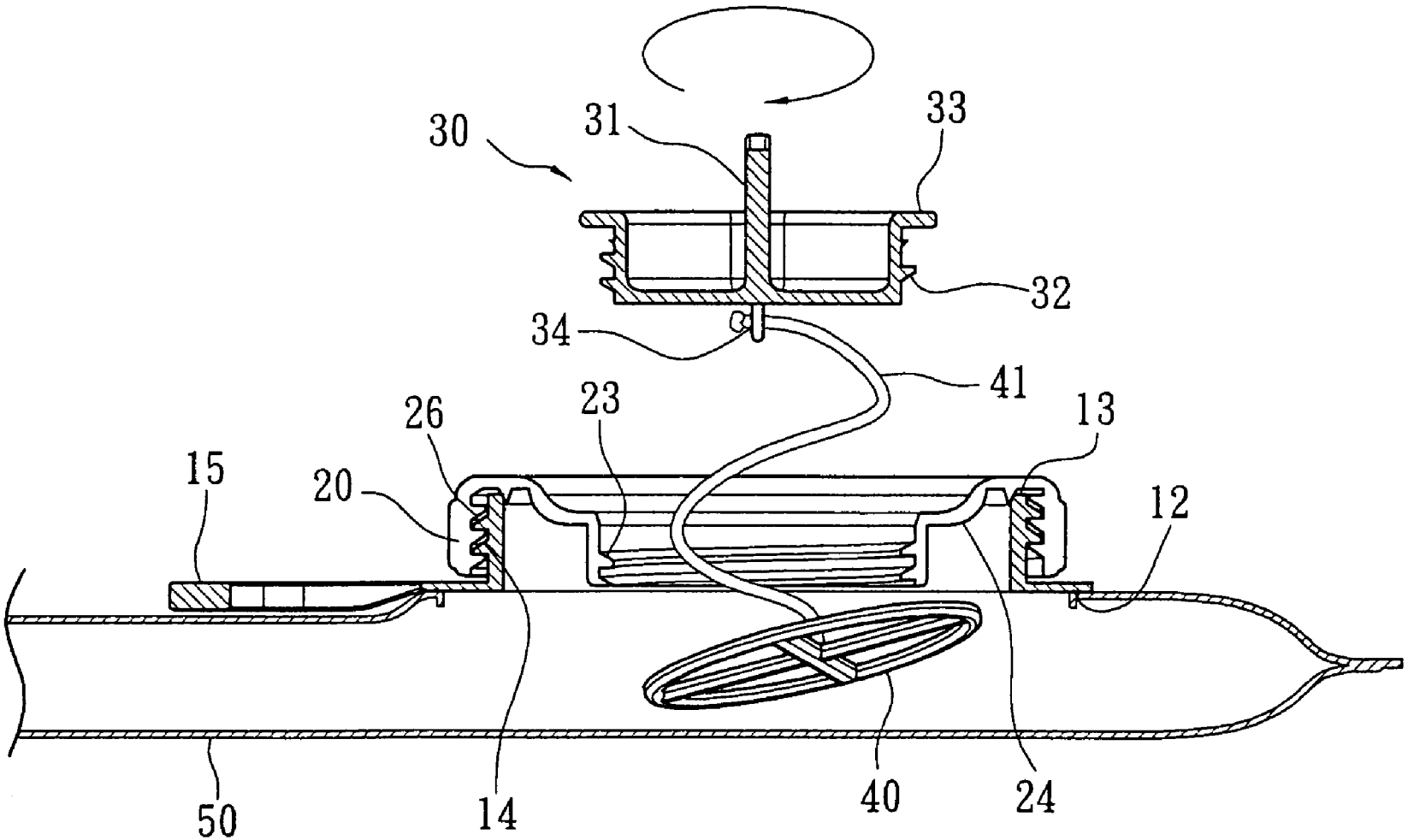
FIG. 3 is a cross-sectional view of the invention showing the cover being switched.
Figure 4:
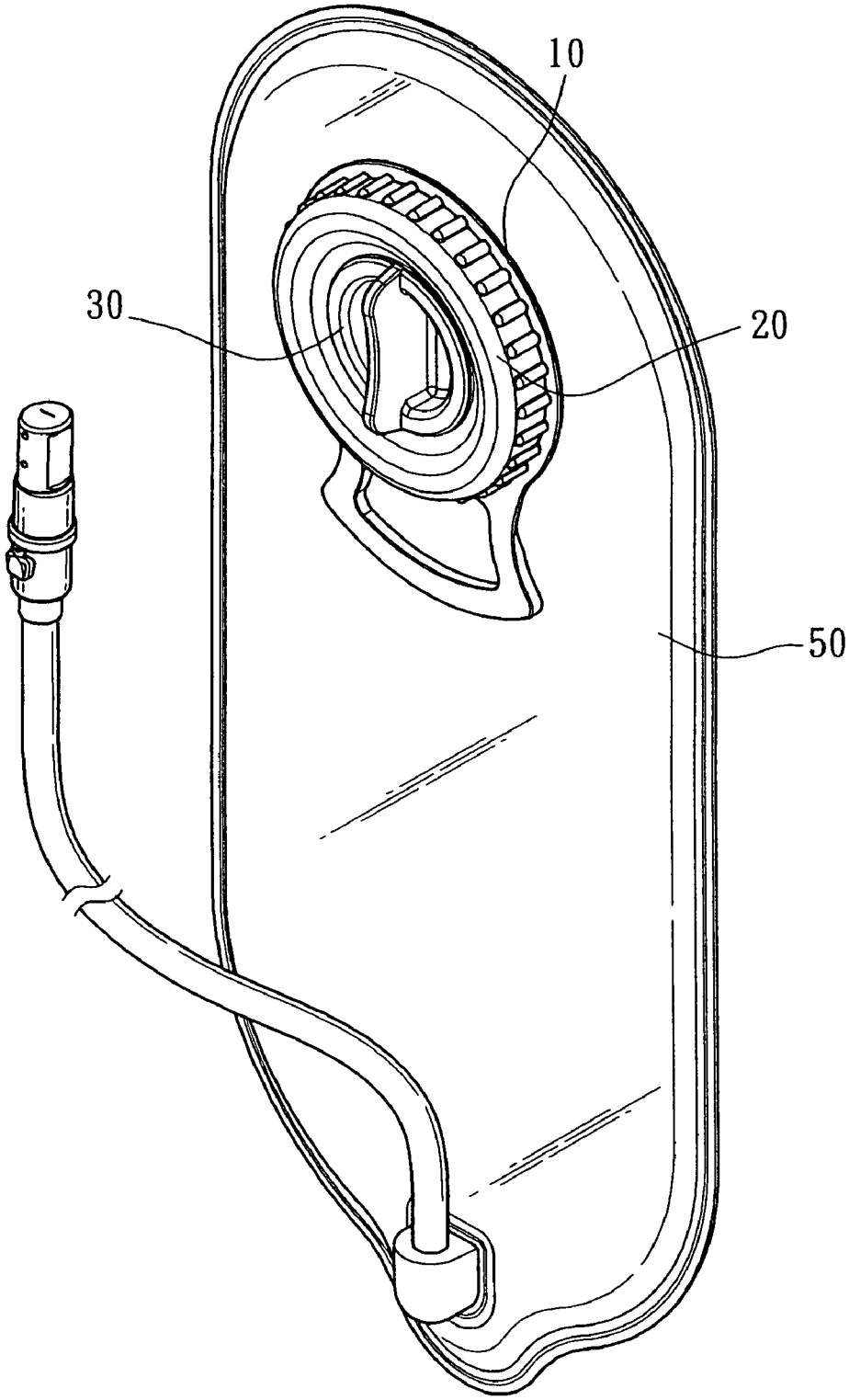
FIG. 4 is a perspective view showing combination of the invention with a water bag.

As shown in FIGS. 1 to 3, the combination of large and small covers for a water bag according to the invention is composed of a base 10, a cover of large diameter 20, a cover of small diameter 30, an inner ring 40, and a connecting string 41. The cover of large diameter 20 can be coupled onto the top of the base 10, while the cover of small diameter 30 can be coupled onto the top of the cover of large diameter 20, such that the two covers can be respectively coupled and loosened. Via a connecting string 41, the cover of small diameter 30 is connected with an inner ring 40 disposed in another side of the cover of large diameter 20, such that when the user can loosen the cover of small diameter 30 for refilling drinking water and open the cover of large diameter 20 for cleaning inside of the water bag after use.

The base 10 is provided with a central hole 11, a horizontal extending rim 12 at the periphery, and a leak-proof flange 13 at the top rim. The leak-proof flange 13 can be closely fastened to the interior threads 26 inside of the cover of large diameter 20 (as shown in FIG. 3) for the purpose of leak-proof Whereas the extension rim 12 is combined to the water bag 50 via heat press. As shown in FIG. 3, the sack wall of the water bag 50 is pressed to adhere to the underneath of the extension rim 12 which is provided on the vertical wall with exterior threads 14 for coupling with the cover of large diameter 20, whereas a handle 15 is provided at the outer rim of the extension rim 12.

The cover of large diameter 20 is provided with interior threads 26 at the inner rim (as shown in FIG. 3) for coupling with the exterior threads 14 of the base 10, a rough portion 22 at the outer rim, and a through hole 25, which is provided with interior threads 23 on the inner wall, at the center. As the cover of large diameter 20 has a central hole, the body thereof presents a flame 24, thereby increasing the rigidity of the structure. Accordingly, when the cover of large diameter 20 is combined with the base 10, their cooperating tolerance in size need not be overly tight since the structure would not transform given the preferred rigidity and would be leak-proof. The through hole 25 at the center of the frame 24 is provided for coupling with the cover of small diameter 30.

On the top of the cover of small diameter 30, which is coupled to the central hole 25 of the cover of large diameter 20, is provided with a switch piece 31, which is in form of a panel extending upwardly above the top of the small cover 30, such that the user can easily rotate the cover by fingers. In addition, exterior threads 32 are provided at the outer rim of the cover of small diameter 30 for coupling with the interior threads 23 on the through hole 25 of the cover of large diameter 20. The small cover 30 is provided with an expanding rim 33 at the top end and an extrusion, which has an aperture 34, on the bottom (as shown in FIG. 3). The aperture 34 may be bound with a connecting string 41 for connecting with an inner ring 40, which is disposed through the other side of the cover of large diameter 20. Since the outer diameter of the inner ring 25 is larger than that of the through hole 25, the inner ring 40 can be stayed inside of the water bag 50 to prevent the cover of small diameter 30 from being lost at the time when it is detached. Concluded above, a combination of large and small covers for a water bag can be accomplished.

Further referring to FIG. 3, when the user intends to refill liquid to the water bag 50, he/she needs only to switch off the cover of small diameter 30. As the cover of small diameter 30 is connected to an inner ring 40 via the connecting string 41, which has a larger diameter than that of the through hole 25 of the cover of large diameter 20, the inner ring 40 would seize the inner rim of the large cover 20 to prevent the cover of small diameter 30 from being lost. And a handle 15 is provided at the extension rim 12 of the base 10 to ease the user to hold the water bag at the time of refilling water.

As shown in FIGS. 2 and 3, when the user intends to clean the interior of the water bag 50, he/she can switch off the cover of large diameter 20 and stretch his/her hand inside of the water bag. Besides, a rough portion 22 provided at the outer rim of the cover of large diameter 20 can allow the user to grip firmly to apply force for loosening the cover 20. The frame 24 of the large cover 20 is further provided for the purposes of enhancing the rigidity of the cover 20, such that the cover 20 would not easily be transformed, the coupled elements would have an appropriate tightness for coupling, and the user can easily apply force. Furthermore, a leak-proof flange 13 is provided at the top rim of the base 10 for firmly fastening to the interior of the cover of small diameter 30 to obtain the purpose of leak-proof, such that the interior threads 26 of the cover of large diameter 20 and the exterior threads 14 of the base need not be tightly coupled, and that the user can easily loosen the cover 20 for use.

Figure 5:
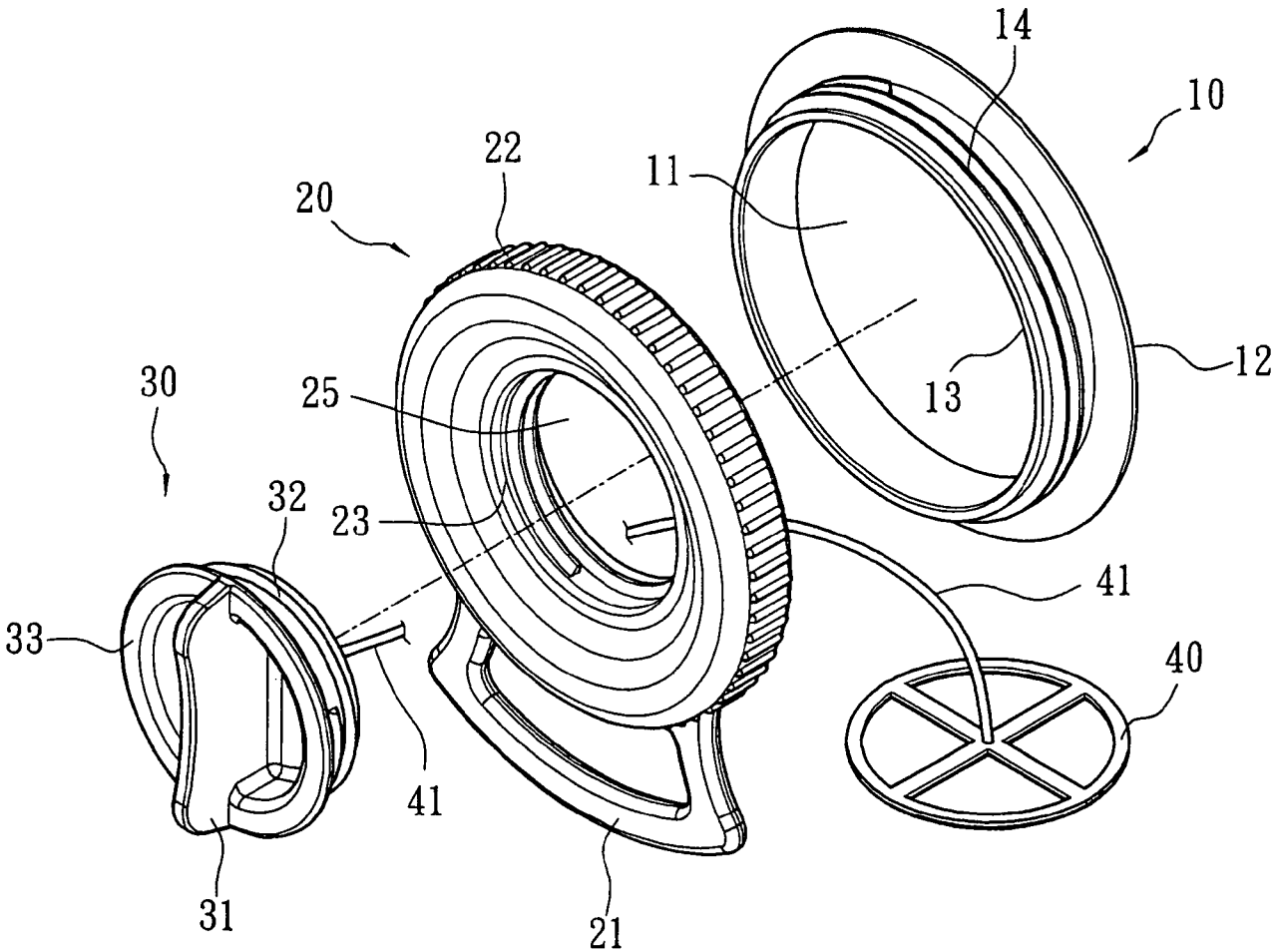
FIG. 5 is an exploded view of another embodiment of the invention.
Figure 6:
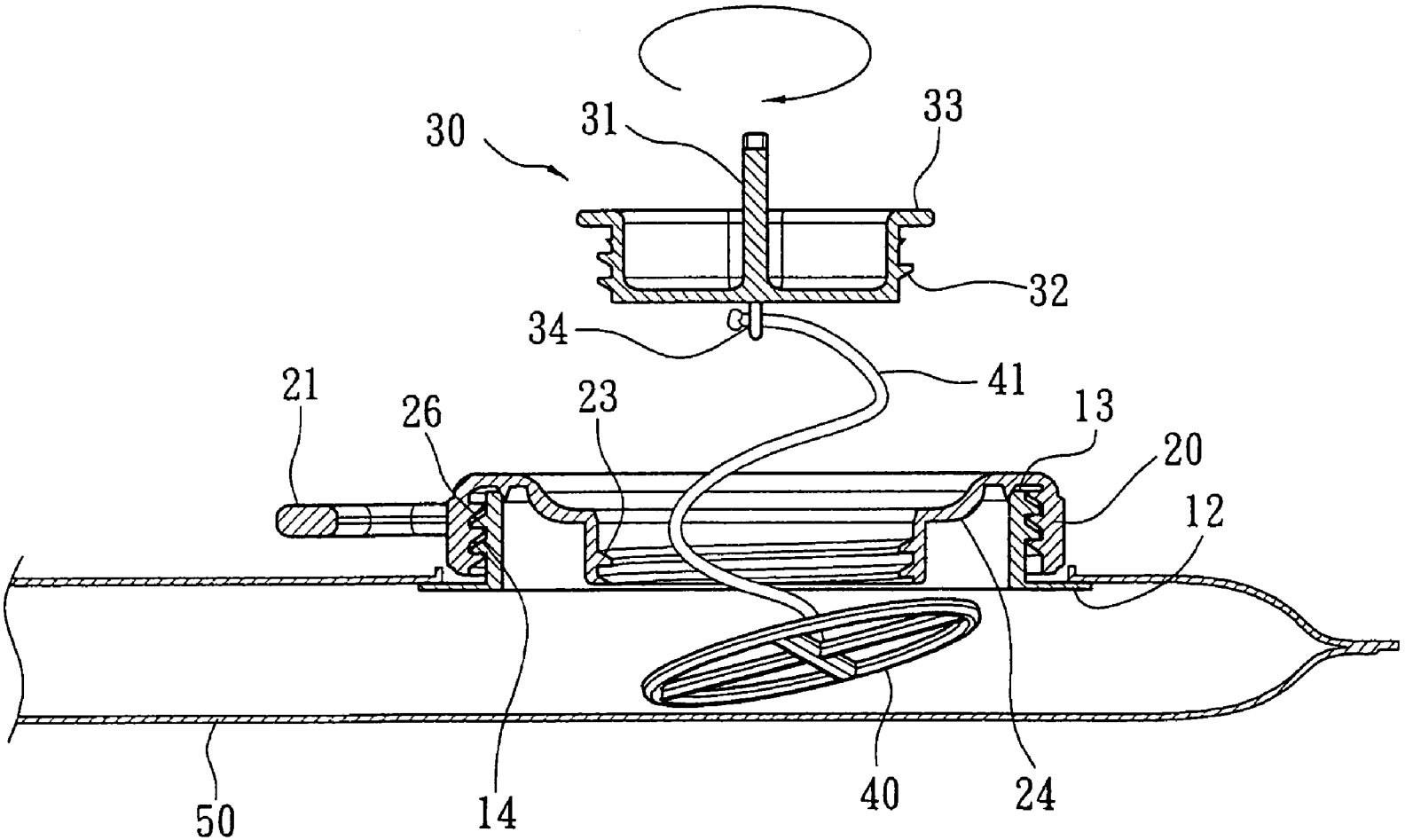
FIG. 6 is a cross-sectional view of the embodiment presented in FIG. 5, showing the cover being switched.

Referring to FIGS. 5 and 6, according to the afore-mentioned idea, the inventor has alternatively changed the position of the handle to the cover of large diameter 20, such that the extension rim 12 on the bottom of the base 10 presents a complete circle. Accordingly, the base 10 and the sack wall of the water bag 50 would be integrally pressed to combine above the extension rim 12. While the handle 21 is provided at the outer rim of the cover of large diameter 20, the user can likewise held it easily for refilling water.

Concluded above, the combination of large and small covers for a water bag according to the invention can allow both of the large and small covers to be loosened easily and respectively for various uses. While certain novel features of this invention have been shown and described and are pointed out in the annexed Claims, it is not intended to be limited to the details above, since it will be understood that various omissions, modifications, substitutions and changes in the forms and details of the device illustrated and in its operation can be made by those skilled in the art without departing in any way from the spirit of the present invention.

Although specific embodiments have been illustrated and described, it will be obvious to those skilled in the art that various modifications may be made without departing from what is intended to be limited solely by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A combination of large and small covers for a water bag, comprising:

a base which is in form of a cylinder vertically provided with an extension rim around a periphery of an end of said base, a vertical wall of said base being provided with exterior threads, another end of said base being provided with a leak-proof flange, said extension rim of said base being provided with a handle;

a cover of small diameter having a periphery provided with exterior threads, an upper end of said cover of small diameter being provided with an expanding rim, a top end of said cover of small diameter being provided with a switch piece;

a cover of large diameter having a skirt provided with interior threads engaged with said exterior threads of said base, said cover of large diameter having a center hole with interior threads for coupling with said exterior threads of said cover of small diameter, said cover of large diameter being provided with a rough portion at an outer rim of said cover of large diameter, said outer rim of said cover of large diameter being provided with a handle;

said cover of small diameter being connected to an inner ring via a connecting string, said inner ring having a diameter larger than that of said center hole of said cover of large diameter and disposed through other side of said center hole thereby preventing said cover of small diameter from being lost; and said cover of small diameter being engageable with said center hole of said cover of large diameter; and said cover of large diameter being coupled with said base which is combined with a water bag;

whereby when a user intends to refill liquid to said water bag, it is only necessary to switch off said cover of small diameter, and when said user intends to clean an interior of said water bag, it is only necessary to switch off said cover of large diameter and stretch a hand inside of said water bag.

* * * * *